US007776450B2

(12) United States Patent
Mizuno et al.

(10) Patent No.: US 7,776,450 B2
(45) Date of Patent: Aug. 17, 2010

(54) THERMAL SPRAYING POWDER COMPRISING CHROMIUM CARBIDE AND ALLOY CONTAINING COBALT OR NICKEL, THERMAL SPRAY COATING, AND HEARTH ROLL

(75) Inventors: Hiroaki Mizuno, Kakamigahara (JP); Satoshi Tawada, Kakamigahara (JP); Isao Aoki, Tajimi (JP); Noriyuki Yasuo, Akashi (JP); Tatsuo Suidzu, Ashiya (JP); Sho Hashimoto, Tatsuno (JP)

(73) Assignee: Fujimi Incorporated, Kiyosu-shi, Aichi (JP)

( * ) Notice: Subject to any disclaimer, the term of this patent is extended or adjusted under 35 U.S.C. 154(b) by 126 days.

(21) Appl. No.: 12/056,370

(22) Filed: Mar. 27, 2008

(65) Prior Publication Data

US 2008/0241522 A1 Oct. 2, 2008

(30) Foreign Application Priority Data

Mar. 27, 2007 (JP) ..... 2007-082727

(51) Int. Cl.
*B32B 5/16* (2006.01)

(52) U.S. Cl. ..... 428/570; 423/439; 428/402; 428/546; 428/615; 428/666

(58) Field of Classification Search ..... 428/402, 428/570, 546, 615, 666; 423/439
See application file for complete search history.

(56) References Cited

U.S. PATENT DOCUMENTS 3,617,358 A * 11/1971 Dittrich ..... 427/447
3,941,903 A * 3/1976 Tucker, Jr. ..... 427/451
4,019,875 A * 4/1977 Dittrich et al. ..... 428/570
4,117,179 A * 9/1978 Jackson et al. ..... 427/405
4,275,124 A * 6/1981 McComas et al. ..... 428/564
4,606,948 A * 8/1986 Hajmrle et al. ..... 427/451
4,725,508 A * 2/1988 Rangaswamy et al. ..... 428/570
5,075,129 A * 12/1991 Jackson et al. ..... 427/451
5,141,821 A * 8/1992 Lugscheider et al. ..... 428/614
5,419,976 A * 5/1995 Dulin ..... 428/570
6,071,324 A * 6/2000 Laul et al. ..... 75/252
6,199,281 B1 * 3/2001 Lee et al. ..... 29/895.32
6,482,534 B2 * 11/2002 Itsukaichi et al. ..... 428/569
7,279,221 B2 * 10/2007 Kitamura et al. ..... 428/402
7,282,079 B2 * 10/2007 Mizuno et al. ..... 75/252

FOREIGN PATENT DOCUMENTS

JP 2003-027204 1/2003
JP 2005-206863 8/2005

* cited by examiner

*Primary Examiner*—H. (Holly) T Le
(74) *Attorney, Agent, or Firm*—Vidas, Arrett & Steinkraus P.A.

(57) ABSTRACT

A thermal spraying powder contains 30 to 50% by mass of chromium carbide with the remainder being an alloy containing chromium, aluminum, yttrium, and at least one of cobalt and nickel. The thermal spraying powder has an average particle size of 20 to 60 μm. The thermal spraying powder may contain 20% by mass or less of yttrium oxide in place of a part of the alloy. A thermal spray coating obtained by thermal spraying of the thermal spraying powder, particularly, a thermal spray coating obtained by high-velocity flame spraying of the thermal spraying powder is suitable for the purpose of a hearth roll.

7 Claims, No Drawings

THERMAL SPRAYING POWDER COMPRISING CHROMIUM CARBIDE AND ALLOY CONTAINING COBALT OR NICKEL, THERMAL SPRAY COATING, AND HEARTH ROLL

BACKGROUND OF THE INVENTION

The present invention relates to a thermal spraying powder, a thermal spray coating obtained from the thermal spraying powder, and a hearth roll including the thermal spray coating obtained from the thermal spraying powder.

A roll for conveying a steel plate called a hearth roll is disposed in a heat treatment furnace such as a steel plate continuous annealing furnace. A steel plate is subjected to heat treatment in a furnace maintained under a reduction atmosphere of $N_2/H_2$ or the like. At that time, a deposition called a buildup is formed on the surface of the hearth roll by a reaction of the roll with the steel plate in some cases. When a buildup is formed on the surface of the hearth roll, a pressed scar or the like is formed on the surface of a steel plate conveyed on the hearth roll, thereby resulting in poor quality of the steel plate. Therefore, when a buildup is formed on the surface of the hearth roll, it is necessary that the operation of the furnace be immediately stopped and the surface of the hearth roll be cleaned, so that production efficiency is remarkably reduced. Accordingly, buildup formation has been conventionally prevented by providing a thermal spray coating on the surface of the hearth roll.

Meanwhile, in recent years, the demand for high tension steel has increased. The high tension steel contains elements such as manganese (Mn) and silicon (Si) as solid solution reinforcing elements in an amount larger than that of normal steel. Since these elements are easily oxidized, a layer enriched in oxides of these elements is formed on the surface of a high tension steel plate. Since a manganese enriched layer particularly tends to form a buildup by reacting with a thermal spray coating provided on the surface of a hearth roll, this manganese buildup has caused a problem in a hearth roll for conveying a high tension steel plate. As the required quality of a steel plate has become increasingly strict, a problem of the buildup has become increasingly apparent. Therefore, development of a thermal spraying powder aiming such a thermal spray coating as to solve these problems has been conducted (see, for example, Japanese Laid-Open Patent Publication Nos. 2005-206863 and 2003-27204).

Particularly high buildup resistance is required for a thermal spray coating provided on the surface of a hearth roll used in a high temperature zone (for example, 900° C. or more) in a furnace. At the same time, high thermal shock resistance which can resist without causing separation by thermal shock accompanied by, for example, passing a steel plate therethrough is also required for such a thermal spray coating. However, a thermal spray coating for satisfying these requirements has not yet been obtained under the present circumstances.

SUMMARY OF THE INVENTION

Accordingly, an objective of the present invention is to provide a thermal spraying powder capable of forming a thermal spray coating suitable for the use of a hearth roll, a thermal spray coating obtained from the thermal spraying powder, and a hearth roll including the thermal spray coating.

To achieve the foregoing objective and in accordance with a first aspect of the present invention, a thermal spraying powder is provided. The thermal spraying powder contains 30 to 50% by mass of chromium carbide with the remainder being an alloy containing chromium, aluminum, yttrium, and at least one of cobalt and nickel. The thermal spraying powder has an average particle size of 20 to 60 μm.

In accordance with a second aspect of the present invention, a thermal spray coating obtained by high-velocity flame spraying of the thermal spraying powder according to the above first aspect of the present invention is provided.

In accordance with a third aspect of the present invention, a hearth roll having the thermal spray coating according to the above second aspect of the present invention provided on a surface thereof is provided.

Other aspects and advantages of the invention will become apparent from the following description, illustrating by way of example the principles of the invention.

DETAILED DESCRIPTION OF THE PREFERRED EMBODIMENTS

Hereinafter, one embodiment of the present invention will be described.

A thermal spraying powder according to the present embodiment contains 30 to 50% by mass of chromium carbide with the remainder being an alloy. In other words, the thermal spraying powder contains 30 to 50% by mass of chromium carbide and 50 to 70% by mass of an alloy. The alloy contains chromium, aluminum, yttrium, and at least one of cobalt and nickel. More specifically, as the alloy, either one of a CoCrAlY alloy, a NiCrAlY alloy, a CoNiCrAlY alloy, and a NiCoCrAlY alloy may be used. From the viewpoint of improving buildup resistance of a thermal spray coating obtained from the thermal spraying powder, the chromium content, the aluminum content, and the yttrium content in the alloy are preferably 15 to 25% by mass, 6 to 12% by mass, and 0.3 to 1% by mass, respectively.

It is essential that the content of chromium carbide in the thermal spraying powder be 30% by mass or more (in other words, the content of an alloy in the thermal spraying powder be 70% by mass or less). As the content of chromium carbide is increased, buildup resistance of a thermal spray coating obtained from the thermal spraying powder is improved. This is considered because chromium carbide in the thermal spray coating is less likely to form a reaction layer even when it comes into contact with a manganese enriched layer and buildup formation is thus suppressed. Further, as the content of chromium carbide is increased, the hardness of a thermal spray coating obtained from the thermal spraying powder is improved and abrasion resistance of the thermal spray coating is thus improved. From this point of view, if the content of chromium carbide in the thermal spraying powder is 30% by mass or more, a thermal spray coating having excellent buildup resistance and abrasion resistance suitable for the use of a hearth roll is obtained from the thermal spraying powder. In order to further significantly improve buildup resistance and abrasion resistance of a thermal spray coating obtained from the thermal spraying powder, the content of chromium carbide in the thermal spraying powder is preferably 33% by mass or more, and more preferably 35% by mass or more. In other words, the content of an alloy in the thermal spraying powder is preferably 67% by mass or less, and more preferably 65% by mass or less.

It is also essential that the content of chromium carbide in the thermal spraying powder be 50% by mass or less (in other words, the content of an alloy in the thermal spraying powder be 50% by mass or more). As the content of chromium carbide is decreased, the toughness of a thermal spray coating obtained from the thermal spraying powder is improved and thermal shock resistance of the thermal spray coating is thus improved. From this point of view, if the content of chromium carbide in the thermal spraying powder is 50% by mass or less, a thermal spray coating having excellent thermal shock resistance suitable for the use of a hearth roll is obtained from the thermal spraying powder. In order to further significantly improve thermal shock resistance of a thermal spray coating obtained from the thermal spraying powder, the content of chromium carbide in the thermal spraying powder is preferably 47% by mass or less, and more preferably 45% by mass or less. In other words, the content of an alloy in the thermal spraying powder is preferably 53% by mass or more, and more preferably 55% by mass or more.

It is essential that the thermal spraying powder has an average particle size of 20 μm or more. As the average particle size of the thermal spraying powder is increased, the amount of fine particles contained in the thermal spraying powder which may cause over-melting during thermal spraying is decreased, and therefore a phenomenon called spitting is less likely to occur during thermal spraying of the thermal spraying powder. The term "spitting" refers to a phenomenon that deposition formed by adhesion and deposition of an over-melt thermal spraying powder to and on an inner wall of a nozzle of a thermal spraying apparatus falls from the inner wall and is mixed in the resultant thermal spray coating during thermal spraying of the thermal spraying powder. Since the deposition is exposed to flame in the nozzle for a long period of time to cause deterioration such as oxidation, when spitting occurs, performance of a thermal spray coating obtained from the thermal spraying powder may be reduced including buildup resistance. From this point of view, if the thermal spraying powder has an average particle size of 20 μm or more, the reduction in buildup resistance of the thermal spray coating by occurrence of spitting is strongly suppressed. In order to more strongly suppress the reduction in buildup resistance of the thermal spray coating by occurrence of spitting, the thermal spraying powder has an average particle size of preferably 23 μm or more, and more preferably 25 μm or more.

It is essential that the thermal spraying powder has an average particle size of 60 μm or less. As the average particle size of the thermal spraying powder is decreased, the density of a thermal spray coating obtained from the thermal spraying powder is improved, and performance of the thermal spray coating is thus improved including buildup resistance and abrasion resistance. When a thermal spray coating has a poor density, a buildup may be formed from an opening pore on a surface of the coating as a starting point. From this point of view, if the thermal spraying powder has an average particle size of 60 μm or less, a thermal spray coating having excellent buildup resistance and abrasion resistance suitable for the use of a hearth roll is obtained from the thermal spraying powder. In order to further significantly improve buildup resistance and abrasion resistance of a thermal spray coating obtained from the thermal spraying powder, the thermal spraying powder has an average particle size of preferably 57 μm or less, and more preferably 55 μm or less.

Particles constituting the thermal spraying powder are preferably granulated and sintered particles. The granulated and sintered particles axe advantageous in that they have good flowability and contain fewer impurities mixed therein at the time of production as compared with melted and crushed particles and sintered and crushed particles. Therefore, a thermal spray coating obtained from the thermal spraying powder of granulated and sintered particles has a uniform texture and performance of the thermal spray coating is thus improved including buildup resistance. The granulated and sintered particles are produced, for example, by granulating and sintering a raw powder comprising a powder of chromium carbide and a powder of the alloy, followed by breaking into smaller particles, and classifying the resultant powder, if necessary. The melted and crushed particles are produced by melting the raw powder, cooling and solidifying the melted powder, followed by crushing, and classifying the resultant powder, if necessary. The sintered and crushed particles are produced by sintering and crushing the raw powder and classifying the resultant powder, if necessary.

When the thermal spraying powder comprises granulated and sintered particles, a raw powder of the granulated and sintered particles preferably has an average particle size of 15 μm or less. As the average particle size of the raw powder is decreased, the size of each chromium carbide particle and the size of each alloy region in a thermal spray coating obtained from the thermal spraying powder are decreased, and the uniformity of the thermal spray coating is thus improved. From this point of view, if the raw powder has an average particle size of 15 μm or less, a thermal spray coating with particularly high uniformity is obtained from the thermal spraying powder.

When the thermal spraying powder comprises granulated and sintered particles, the granulated and sintered particles preferably have a crushing strength of 10 MPa or more. As the crushing strength of the granulated and sintered particles is increased, collapse of granulated and sintered particles in the thermal spraying powder is suppressed. This collapse is one which may occur in a tube for connecting a powder feeder to a thermal spraying apparatus while the thermal spraying powder is fed to the thermal spraying apparatus from the powder feeder, or when the thermal spraying powder fed to the thermal spraying apparatus is charged into thermal spraying flame. When the collapse of granulated and sintered particles occurs, fine particles which may cause over-melting during thermal spraying are formed in the thermal spraying powder, so that spitting is likely to occur during thermal spraying of the thermal spraying powder. From this point of view, if the granulated and sintered particles have a crushing strength of 10 MPa or more, the collapse of granulated and sintered particles is strongly suppressed, so that the occurrence of spitting is suppressed.

A thermal spraying powder of the present embodiment is used for the purpose of forming a thermal spray coating by high-velocity flame spraying such as HVOF. In the case of high-velocity flame spraying, the resultant thermal spray coating is excellent in densities, texture uniformity, and less thermal deterioration as compared with other thermal spraying methods, and a thermal spray coating having excellent buildup resistant and thermal shock resistance is formed from the thermal spraying powder. Accordingly, the thermal spraying of a thermal spraying powder of the present embodiment is preferably performed by high-velocity flame spraying.

A thermal spray coating obtained from the thermal spraying powder is provided, for example, on the surface of a hearth roll. The thermal spray coating provided on the surface of a hearth roll is formed by high-velocity flame spraying of the thermal spraying powder. This thermal spray coating preferably has a thickness of 40 to 300 μm from the viewpoint of obtaining excellent buildup resistance and excellent thermal shock resistance.

According to the present embodiment, the following advantage is obtained.

A thermal spraying powder of the present embodiment contains 30 to 50% by mass of chromium carbide with the remainder being an alloy containing chromium, aluminum, yttrium, and at least one of cobalt and nickel, and has an average particle size of 20 to 60 μm. Therefore, a thermal spray coating obtained from the thermal spraying powder is excellent in buildup resistance and abrasion resistance, and is thus suitable for the purpose of a hearth. In other words, the thermal spraying powder can form a thermal spray coating which satisfies both buildup resistance and thermal shock resistance required when used in a high-temperature zone in a heat treatment furnace and which is suitable for the use of a hearth roll.

The above-mentioned embodiment may be modified as follow.

A thermal spraying powder of the present embodiment may contain yttrium oxide in place of a part of the alloy. Since yttrium oxide is chemically stable and is highly non-reactive, buildup resistance of a thermal spray coating obtained from the thermal spraying powder is improved by adding yttrium oxide. The lesser the content of yttrium oxide in the thermal spraying powder, the more a thermal spray coating obtained from the thermal spraying powder improves the density and thermal shock resistance. Therefore, the content of yttrium oxide in the thermal spraying powder is preferably 20% by mass or less, more preferably 17% by mass or less, and further preferably 15% by mass or less.

Next, the present invention will be specifically described with reference to Examples and Comparative Examples.

In Examples 1 to 15 and Comparative Examples 1 to 6, thermal spraying powders each comprising granulated and sintered particles containing $Cr_3C_2$ and an alloy, and further $Y_2O_3$, if necessary, were prepared. In Example 16, a thermal spraying powder comprising a mixture of a $Cr_3C_2$ powder, a $Y_2O_3$ powder, and an alloy powder was prepared. Then, each of the thermal spraying powders was thermally sprayed to form a thermal spray coating. The details of each of Examples and Comparative Examples axe described as shown in Table 1.

The column of "$Cr_3C_2$ Content" in Table 1 shows the content of $Cr_3C_2$ in the thermal spraying powder of each of Examples and Comparative Examples.

The column of "$Y_2O_3$ Content" in Table 1 shows the content of $Y_2O_3$ in the thermal spraying powder of each of Examples and Comparative Examples.

The column of "Composition of Alloy" in Table 1 shows the composition of the alloy in the thermal spraying powder of each of Examples and Comparative Examples.

The columns of "Average Particle Size of Thermal Spraying Powder" and "Average Particle Size of Raw Powder" in Table 1 show the measurement results of the average particle size of the thermal spraying powder and the average particle size of the raw powder of the thermal spraying powder, respectively, in each of Examples and Comparative Examples A laser diffraction/scattering particle size measuring apparatus "LA-300" manufactured by HORIBA Ltd was used for measurement of the average particle sizes. The "average particle size" herein represents the particle size of the particle lastly added up when the volume of each of particles is added up from the particle having the smallest particle size in ascending order until the added up volume of particles reaches 50% of the added up volume of all the particles.

In the column of "Kind of Thermal Spraying Powder" in Table 1, "Granulated and Sintered" shows that the thermal spraying powder comprises granulated and sintered particles, and "Blend" shows that the thermal spraying powder comprises a mixture of a $Cr_3C_2$ powder, a $Y_2O_3$ powder, and an alloy powder.

The column of "Crushing Strength" in Table 1 shows the measurement results of crushing strength of granulated and sintered particles in the thermal spraying powder of each of Examples 1 to 15 and Comparative Examples 1 to 6. Specifically, the crushing strength indicates crushing strength σ [MPa] of granulated and sintered particles in each of the thermal spraying powders calculated according to the expression: $\sigma=2.8\times L/\pi/d^2$. In the above expression, L and d represent a critical load [N] and an average particle size of a thermal spraying powder [mm], respectively. The term of "critical load" refers to the magnitude of compression load applied to granulated and sintered particles at the point of time of drastically increasing the displacement of an indenter when a compression load increased at a constant rate is applied to the granulated and sintered particles with the indenter A microcompression tester "MCTE-500" manufactured by Shimadzu Corporation was used for measurement of this critical load.

The column of "Thermal Spraying Method" in Table 1 shows a thermal spraying method used when the thermal spraying powder of each of Examples and Comparative Examples was thermally sprayed to obtain a thermal spray coating. In the same column, "HVOF" indicates high-velocity flame spraying under the conditions shown in Table 2, and "Plasma" indicates plasma thermal spraying under the conditions shown in Table 3.

The column of "Coating Thickness" in Table 1 shows the measurement results of the thickness of a thermal spray coating obtained from the thermal spraying powder of each of Examples and Comparative Examples.

The column of "Spitting" in Table 1 shows the evaluation results of the occurrence state of spitting when the thermal spraying powder of each of Examples and Comparative Examples was thermally sprayed to obtain a thermal spray coating. Specifically, after performing continuous thermal spraying for 10 minutes and 20 minutes by using a thermal spraying apparatus, the adhesion state of each thermal spraying powder to the inner wall of a nozzle of the thermal spraying apparatus was observed. Then, each thermal spraying powder was evaluated as "Good (G)" when no adhesion was recognized even after performing continuous thermal spraying for 20 minutes, "Fair (F)" when no adhesion was recognized after performing continuous thermal spraying for 10 minutes, but adhesion was recognized after performing continuous thermal spraying for 20 minutes, and "Poor (P)" when adhesion was recognized after performing continuous thermal spraying for 10 minutes.

The column of "Adhesion Efficiency" in Table 1 shows the evaluation results of adhesion efficiency (thermal spraying yield) when the thermal spraying powder of each of Examples and Comparative Examples was thermally sprayed to obtain a thermal spray coating. Specifically, each thermal spraying powder was evaluated as "Good (G)" when the value of adhesion efficiency determined by dividing the weight of the obtained thermal spray coating by the weight of the thermal spraying powder used was 35% or more, "Fair (F)" when the value was 30% or more and less than 35%, and "Poor (P)" when the value was less than 30%.

The column of "Hardness" in Table 1 shows the evaluation results of hardness measured for the thermal spray coating obtained in each of Examples and Comparative Examples. Specifically, each thermal spray coating was evaluated as "Good (G)" when the Vickers hardness value in the cross-section of the thermal spray coating measured at a load of 2 N using a microhardness tester "HMV-1" manufactured by Shimadzu Corporation was 500 or more, "Fair (F)" when the value was 450 or more and less than 500, and "Poor (P)" when the value was less than 450.

The column of "Porosity" in Table 1 shows the evaluation results of porosity measured for the thermal spray coating obtained in each of Examples and Comparative Examples. Specifically, each thermal spray coating was evaluated as "Good (G)" when the porosity value determined by measuring the cross-section of the thermal spray coating after mirror polishing by image analyzing is 2.0% or less, "Fair (F)" when the value was more than 2.0% and 3.0% or less, and "Poor (P)" when the value was more than 3.0%.

The column of "Abrasion Resistance" in Table 1 shows the evaluation results of abrasion resistance for the thermal spray coating obtained in each of Examples and Comparative Examples. Specifically, after each of the thermal spray coatings was subjected to the dry abrasion test in accordance with Japanese Industrial Standard (JIS) H8682-1 and a plate made of a carbon steel (SS400) used as a standard sample was subjected to the same dry abrasion test, when the ratio of abrasion weight of the thermal spray coating to abrasion weight of the standard sample was 0.4 or less, the thermal spray coating was evaluated as "Good (G)", when the ratio was more than 0.4 and 0.5 or less, the thermal spray coating was evaluated as "Fair (F)", and when the ratio was more than 0.5, the thermal spray coating was evaluated as "Poor (P)". The surface of each of the thermal spray coating and the standard sample were rubbed with abrasive paper called CP180 in US CAMI (Coated Abrasives Manufactures Institute) standard under a load of 30.9 N for a predetermined number of times using a Suga abrasion testing machine in the above dry abrasion test.

The column of "Thermal Shock Resistance" in Table 1 shows the evaluation results of thermal shock resistance for the thermal spray coating obtained in each of Examples and Comparative Examples. Specifically, a heating and cooling cycle was repeated in which a specimen obtained by providing each of the thermal spray coatings on the surface of a substrate made of heat-resistant cast steel (SCH11) is heated in air at 1000° C. for 30 minutes, and then cooled in water. Then, each thermal spray coating was evaluated as "Good (G)" when the separation of the thermal spray coating did not occur even by repeating the heating and cooling cycle 20 times, "Fair (F)" when the separation of the thermal spray coating occurred by repeating the cycle 15 times or more and less than 20 times, and "Poor (P)" when the separation occurred by repeating the cycle less than 15 times.

The column of "Buildup Resistance" in Table 1 shows the evaluation results of buildup resistance for the thermal spray coating obtained in each of Examples and Comparative Examples. Specifically, a specimen was obtained by providing each of the thermal spray coatings on the surface of a substrate made of stainless steel (SUS304). A Manganese oxide powder serving as a buildup supply was sandwiched between the thermal spray coatings of two of the specimens, and the resultant specimens were heated in an atmosphere of $N_2$/3 vol % $H_2$ at 1000° C. for 100 hours. After polishing the cross-section of each of the specimens, the thickness of a manganese diffusion layer in the thermal spray coating was measured using an energy dispersion X-ray analyzer "EDX" manufactured by HORIBA Ltd. Then, each thermal spray coating was evaluated as "Good (G)" when the thickness of the diffusion layer was 20 μm or less, "Fair (F)" when the thickness was more than 20 μm and 50 μm or less, and "Poor (P)" when the thickness was more than 50 μm.

TABLE 1

| | $Cr_3C_2$ Content (% by mass) | $Y_2O_3$ Content (% by mass) | Composition of Alloy | Average Particle Size of Thermal Spraying Powder (μm) | Kind of Thermal Spraying Powder | Average Particle Size of Raw Powder (μm) | Crushing Strength (MPa) |
|---|---|---|---|---|---|---|---|
| Ex 1 | 40 | 15 | CoNiCrAlY | 38 5 | Granulated and Sintered | 10 3 | 12 |
| Ex 2 | 40 | 15 | NiCoCrAlY | 36 3 | Granulated and Sintered | 11 4 | 30 |
| Ex 3 | 40 | 15 | CoNiCrAlY | 22 3 | Granulated and Sintered | 10 3 | 25 |
| C Ex 1 | 40 | 15 | CoNiCrAlY | 17 3 | Granulated and Sintered | 10 3 | 25 |
| Ex 4 | 40 | 15 | CoNiCrAlY | 54 9 | Granulated and Sintered | 10 3 | 25 |
| C Ex 2 | 40 | 15 | CoNiCrAlY | 62 8 | Granulated and Sintered | 10 3 | 25 |
| Ex 5 | 31 | 15 | CoNiCrAlY | 36 3 | Granulated and Sintered | 10 3 | 25 |
| C Ex 3 | 27 | 15 | CoNiCrAlY | 36 3 | Granulated and Sintered | 10 3 | 25 |
| Ex 6 | 47 | 15 | CoNiCrAlY | 36 3 | Granulated and Sintered | 10 3 | 25 |
| C. Ex. 4 | 54 | 15 | CoNiCrAlY | 36 3 | Granulated and Sintered | 10 3 | 25 |
| Ex 7 | 40 | 15 | CoCrAlY | 36 3 | Granulated and Sintered | 10 3 | 25 |
| Ex 8 | 40 | 15 | NiCrAlY | 36 3 | Granulated and Sintered | 10 3 | 25 |
| C Ex 5 | 40 | 15 | NiCr | 36 3 | Granulated and Sintered | 10 3 | 25 |
| Ex 9 | 40 | 0 | CoNiCrAlY | 38 5 | Granulated and Sintered | 10 3 | 25 |
| Ex 10 | 40 | 8 | CoNiCrAlY | 38 5 | Granulated and Sintered | 10 3 | 25 |
| Ex 11 | 40 | 15 | CoNiCrAlY | 38 5 | Granulated and Sintered | 15 5 | 25 |
| Ex 12 | 40 | 15 | CoNiCrAlY | 38 5 | Granulated and Sintered | 9 8 | 8 |
| Ex 13 | 40 | 10 | CoNiCrAlY | 35 | Granulated | 10 3 | 25 |

TABLE 1-continued

| | | | | | | | |
|---|---|---|---|---|---|---|---|
| Ex. 14 | 40 | 10 | CoNiCrAlY | 35 | and Sintered Granulated and Sintered | 10 3 | 24 |
| Ex 15 | 35 | 23 | CoNiCrAlY | 35 | Granulated and Sintered | 10 3 | 22 |
| Ex. 16 | 40 | 10 | CoNiCrAlY | 35 | Blend | 35 | — |
| C Ex 6 | 45 | 15 | CoNiCrAlY | 35 | Granulated and Sintered | 10 3 | 25 |

| | Thermal Spraying Method | Coating Thickness (μm) | Spitting | Adhesion Efficiency | Hardness | Porosity | Abrasion Resistance | Thermal Shock Resistance | Buildup Resistance |
|---|---|---|---|---|---|---|---|---|---|
| Ex 1 | HVOF | 200 | G | G | G | G | G | G | G |
| Ex 2 | HVOF | 200 | G | G | G | G | G | G | G |
| Ex 3 | HVOF | 200 | F | G | G | G | F | G | F |
| C Ex 1 | HVOF | 200 | P | F | F | G | F | G | P |
| Ex 4 | HVOF | 200 | G | F | G | F | F | G | F |
| C Ex 2 | HVOF | 200 | G | P | F | P | F | G | P |
| Ex 5 | HVOF | 200 | F | G | F | G | F | G | F |
| C Ex 3 | HVOF | 200 | F | G | P | G | P | G | P |
| Ex 6 | HVOF | 200 | G | F | G | G | G | F | G |
| C. Ex. 4 | HVOF | 200 | G | P | G | G | G | P | G |
| Ex 7 | HVOF | 200 | G | G | G | G | G | G | G |
| Ex 8 | HVOF | 200 | G | G | G | G | G | G | G |
| C Ex 5 | HVOF | 200 | G | G | G | G | G | G | P |
| Ex 9 | HVOF | 200 | G | G | G | G | G | G | G |
| Ex 10 | HVOF | 200 | G | G | G | G | G | G | G |
| Ex 11 | HVOF | 200 | G | G | F | F | F | F | F |
| Ex 12 | HVOF | 200 | F | G | G | G | F | G | F |
| Ex 13 | HVOF | 30 | G | G | G | G | G | G | F |
| Ex. 14 | HVOF | 350 | G | G | G | G | G | F | G |
| Ex 15 | HVOF | 300 | G | F | F | F | F | F | G |
| Ex. 16 | HVOF | 30 | G | F | F | F | F | G | F |
| C Ex 6 | Plasma | 200 | G | G | F | P | F | P | P |

TABLE 2

| | |
|---|---|
| Thermal spraying apparatus: | High-velocity flame spraying apparatus "JP-5000" manufactured by Praxair/TAFA |
| Oxygen flow rate: | 1900 scfh (893 L/min) |
| Kerosene flow rate: | 5.1 gph (0 32 L/min) |
| Thermal spraying distance: | 380 mm |
| Barrel length of thermal spraying apparatus: | 101 6 mm |
| Feed rate of thermal spraying powder: | 60 g/min |

TABLE 3

| | |
|---|---|
| Thermal spraying apparatus: | Plasma thermal spraying apparatus "SG-100" manufactured by Praxair |
| Argon gas pressure: | 0 34 MPa |
| Helium gas pressure: | 0 34 MPa |
| Voltage: | 35 V |
| Electric current: | 750 A |
| Thermal spraying distance: | 120 mm |

As shown in Table 1, the thermal spray coating of each of Examples 1 to 16 was "Good" or "Fair" with respect to both evaluations for thermal shock resistance and buildup resistance, and therefore practically satisfactory results were obtained. In contrast, the thermal spray coating of each of Comparative Examples 1 to 6 was "Poor" with respect to one of evaluations for thermal shock resistance and buildup resistance, and therefore practically satisfactory results were not obtained.

The invention claimed is:

1. A thermal spraying powder comprising 31 to 50% by mass of chromium carbide with the remainder being an alloy containing chromium, aluminum, yttrium, and at least one of cobalt and nickel, and wherein the thermal spraying powder has an average particle size of 20 to 60 μm.

2. The thermal spraying powder according to claim 1, comprising 20% by mass or less of yttrium oxide in place of a part of the alloy.

3. The thermal spraying powder according to claim 1, wherein the thermal spraying powder comprises granulated and sintered particles formed of a raw powder having an average particle size of 15 μm or less, and the granulated and sintered particles have a crushing strength of 10 MPa or more.

4. The thermal spraying powder according to claim 1, wherein the content of chromium carbide in the thermal spraying powder is 35 to 50% by mass.

5. A thermal spray coating obtained by high-velocity flame spraying of the thermal spraying powder according to claim 1.

6. A hearth roll having the thermal spray coating according to claim 5 provided on a surface thereof.

7. The hearth roll according to claim 6, wherein the thermal spray coating has a thickness of 40 to 300 μm.

* * * * *

UNITED STATES PATENT AND TRADEMARK OFFICE

CERTIFICATE OF CORRECTION

PATENT NO. : 7,776,450 B2
APPLICATION NO. : 12/056370
DATED : August 17, 2010
INVENTOR(S) : Hiroaki Mizuno et al.

It is certified that error appears in the above-identified patent and that said Letters Patent is hereby corrected as shown below:

On the title page item (73), Assignee, Tocalo Co., Ltd. has been added

Signed and Sealed this
Fourth Day of January, 2011

David J. Kappos

David J. Kappos
*Director of the United States Patent and Trademark Office*